US007188371B2

(12) United States Patent
Ragot

(10) Patent No.: US 7,188,371 B2
(45) Date of Patent: Mar. 13, 2007

(54) AQUATIC GARMENT HAVING AN ERGONOMICALLY CURVED OPENING

(75) Inventor: Jean-Marc Ragot, Groisy (FR)

(73) Assignee: Salomon S.A., Metz-Tessy (FR)

( * ) Notice: Subject to any disclaimer, the term of this patent is extended or adjusted under 35 U.S.C. 154(b) by 279 days.

(21) Appl. No.: 10/921,329

(22) Filed: Aug. 19, 2004

(65) Prior Publication Data

US 2005/0028241 A1 Feb. 10, 2005

Related U.S. Application Data

(63) Continuation of application No. PCT/FR03/00539, filed on Feb. 18, 2003.

(30) Foreign Application Priority Data

Feb. 20, 2002 (FR) ..... 02 02236

(51) Int. Cl.
*A41D 13/012* (2006.01)

(52) U.S. Cl. ..... 2/82; 2/2.15

(58) Field of Classification Search ..... 2/2.15, 2/2.17, 2.14, 402, 69.5, 79, 82, 51, 84
See application file for complete search history.

(56) References Cited

U.S. PATENT DOCUMENTS

| | | | | |
|---|---|---|---|---|
| 2,582,811 A | | 1/1952 | Williams | 2/2.1 |
| 3,665,517 A | * | 5/1972 | Hyman | 2/84 |
| 4,275,467 A | | 6/1981 | Doetler | 2/82 |
| 4,829,603 A | * | 5/1989 | Schnoor et al. | 2/69 |
| 4,862,517 A | * | 9/1989 | Meistrell | 2/2.17 |
| 5,191,658 A | | 3/1993 | Meistrell | 2/2.1 R |
| 6,654,963 B2 | * | 12/2003 | Fayle et al. | 2/84 |

FOREIGN PATENT DOCUMENTS

| | | |
|---|---|---|
| DE | 19831432 | 8/1999 |
| FR | 1227959 | 12/1961 |
| FR | 2242940 | 4/1975 |
| GB | 546082 | 6/1942 |

* cited by examiner

*Primary Examiner*—Gary L. Welch
*Assistant Examiner*—Andrew W. Sutton
(74) *Attorney, Agent, or Firm*—Greenblum & Bernstein, P.L.C.

(57) ABSTRACT

A garment, such as an article of aquatic sportswear, that includes a torso-forming portion having a front surface and a rear surface, and which is provided with openings for the passage of the head, legs, and arms. The garment includes an opening in the form of a slit provided with a fastening mechanism, such as a slide fastener, for selectively opening and closing the slit. The slit and the slide fastener includes an essentially rectilinear main portion which extends into a curved end portion.

1 Claim, 1 Drawing Sheet

AQUATIC GARMENT HAVING AN ERGONOMICALLY CURVED OPENING

CROSS-REFERENCE TO RELATED APPLICATION

This application is a continuation of International Patent Application No. PCT/FR03/00539, having an international filing date of Feb. 18, 2003, the disclosure of which is hereby incorporated by reference thereto in its entirety, and the priority of which is hereby claimed under 35 U.S.C. §120.

This application is based upon French Patent Application No. 02.02236, filed Feb. 20, 2002, the disclosure of which is hereby incorporated by reference thereto in its entirety and the priority of which is hereby claimed under 35 U.S.C. §119.

BACKGROUND OF THE INVENTION

1. Field of the Invention

The invention relates to garments, such as sportswear, and more particularly aquatic sportswear, such as those that are generally referred to as suits, and which are more particularly adapted to nautical or underwater sporting activities, such as surfing, board sailing, diving, etc.

2. Description of Background and Relevant Information

Suits of the aforementioned type are generally classified into two categories: the dry or impervious suits in which water does not penetrate inside the suit, and the wet suits in which a thin film of water is allowed between the garment and the diver's body, this film being almost instantaneously heated by the diver's body.

These suits generally comprise a main portion that covers the torso, a front surface of the main portion covering the front portion of the thorax, and a rear surface covering the back. The main portion that covers the torso comprises openings for the passage of the arms, legs, and head. The garment can comprise sleeves and legs for covering the upper limbs and the lower limbs, respectively. It can also comprise a collar or a hood in the area of the opening for the passage of the head.

These garments, in particular the wet suits, are generally made of flexible and elastic material so as to conform to the shape of the body as closely as possible without hindering the movement of the body. For example, these materials can be elastic fabrics (such as fabrics having elasthane), or polychloroprene foams (known under the trademark NEOPRENE®), these materials being capable of being assembled to one another at various locations of the same garment. Depending on the choice of these materials, these garments can offer protection against the cold, impacts, the sun, etc.

Various systems exist that facilitate putting on and taking off such garments. The most widely used system is that which calls for a slit provided in the torso-forming portion of the garment. This slit is often arranged in the rear surface of the garment, and it extends, for example, vertically along the spine, from the neckline down to the lower back. The slit is provided with fastening means which are generally made in the form of a slide fastener, such as a zipper. The zipper is often equipped with a relatively long cord so that the user can operate the zipper to fasten his suit without the assistance of another person.

It has been noted that by fastening the zipper by means of the cord, the user often has some difficulty when he reaches the end of the slide fastener, for example, the upper end of the slide fastener located on the edge of the neckline. This is due to the fact that, at the end of the path, the arm of the user is extended, and he cannot ensure a proper traction in the axis of the slide fastener. The arm generally tends to deviate transversely outward with respect to the body, so that the traction force imposed on the slide fastener is completely offset. As a result, the slide fastener often becomes stuck, which, at the very least, is annoying for the user, but which particularly accelerates the wear of the suit by causing tears around the opening.

Therefore, there remains a need for a new construction for aquatic sportswear, and particularly for the opening and the means for fastening these garments, which ensures putting on and taking off the garment easily while preserving the comfort of the garment.

SUMMARY OF THE INVENTION

To this end, the invention is directed to an aquatic sports garment that comprises a torso-forming portion that has a front surface and a rear surface, and which is provided with openings for the passage of the head, legs, and arms. Further, the garment of the invention comprises an opening in the form of a slit provided with a slide fastener. Moreover, the slit comprises a substantially rectilinear section that is extended by a curved terminal section.

BRIEF DESCRIPTION OF THE DRAWINGS

Other characteristics and advantages of the invention will become apparent upon reading the detailed description that follows, with reference to the annexed drawings, in which.

DETAILED DESCRIPTION OF THE INVENTION

Figure 1:
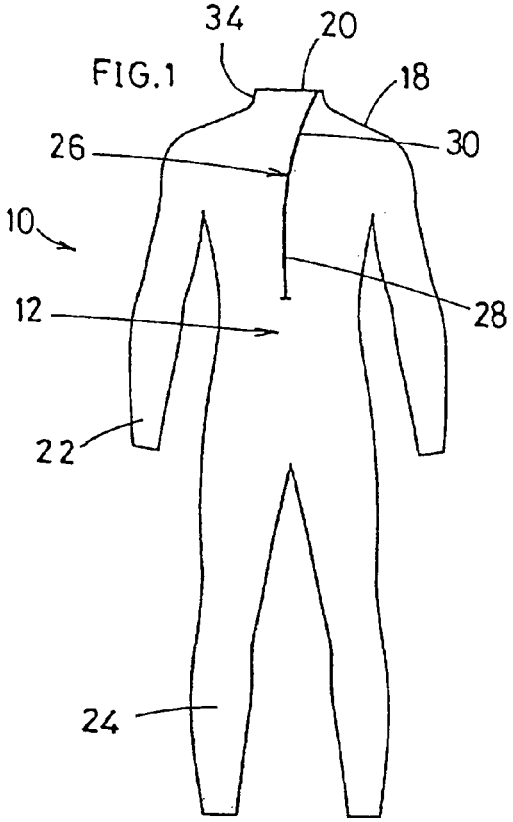
FIG. 1 illustrates a first embodiment of the invention.

The drawing figures illustrate four variants of a garment 10, such as a body-conforming suit and, more particularly, such as a wetsuit.

The drawing figures show a suit 10 that has a main portion 12 covering the user's torso. This torso-forming portion 12 thus comprises a front surface 14 covering the front portion of the torso, and a rear surface 16 covering the back. This portion comprises shoulders 18 on both sides of an opening 20 for the passage of the head. It also comprises openings for the passage of the upper and lower limbs. However, in the example shown, the suit is an integral suit that also comprises sleeves 22 and legs 24 in the extension of these openings. In the illustrated examples, the opening 20 for the passage of the head is in the form of a tubular collar 34 that is adapted to rise along the user's neck. The edge forming the neckline could be positioned lower than as shown, such as at the base of the user's neck, for example.

For example, the suit can be made essentially from polychloroprene foam, in the form of panels assembled to one another. These panels can have different thicknesses or characteristics depending upon their positioning on the garment. The suit can also comprise sections of various materials in the form of elastic fabrics, for example. The suit is preferably a wet suit completely adjusted to the shape of a user's body.

To enable the user to put on and take off the suit easily, the suit is provided with an opening provided in the form of a slit 26 made in the torso-forming portion 12, in the front surface or in the rear surface, this slit being further provided with a fastening mechanism. For example, the fastening mechanism can take the form of a slide fastener and, more particularly, a zipper of the rack or coiled spring type.

According to the invention, the slit forming the opening 26, and also the associated slide fastener, comprises a substantially rectilinear main section 28 and a curved terminal section 30. By curved terminal section is meant the curved section at the end of the slide fastener, where the slide of the slide fastener is located, either when the slit would be open (as in FIGS. 3 and 4, the opening of the suit is then particularly facilitated), or when the slit would be closed (as in FIGS. 1 and 2, the fastening of the suit is then particularly facilitated).

In the first embodiment shown in FIG. 1, the slit as well as the slide fastener/zipper comprises a substantially rectilinear main section 28, which is positioned transversely at the center of the torso, and which extends vertically upward from the bottom or middle of the torso to a zone corresponding to the pectoral muscles or bottom of the shoulder blades. Beyond that, the main section 28 of the slit is extended by a curved terminal section 30 that is curved toward one of the shoulders 18 so as to end up in the upper edge of the neckline 34, offset from the center of the back or front. As an example, the curved end section could meet the neck opening substantially halfway between the center of the garment (whether front or back of the garment) and the side of the garment or, stated another way, substantially in a three-quarter front position (if the slit and the slide fastener/zipper are in the front torso surface) or substantially in a three-quarter rear position (if the slit and the slide fastener/zipper are in the rear torso surface). In this embodiment, the curved section 30 does not have any inflection point, i.e., its direction of curvature does not change over its length.

Figure 2:
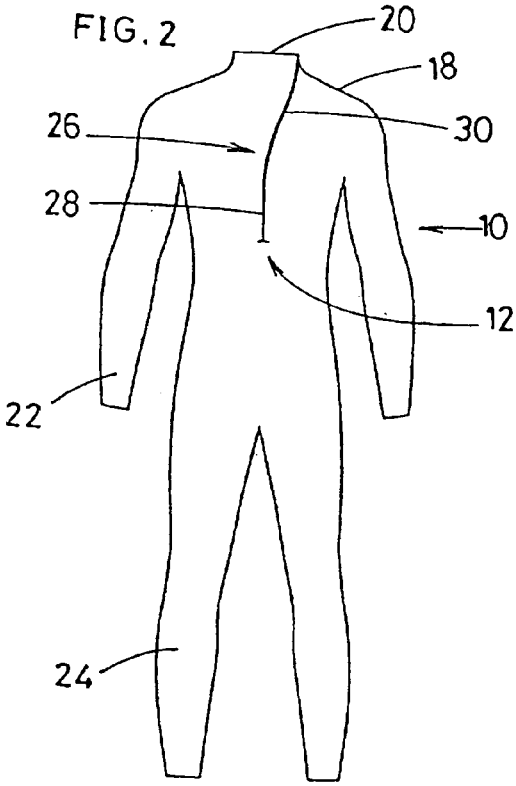
FIG. 2 illustrates a second embodiment of the invention.

The second embodiment shown in FIG. 2, the main section 28 is substantially identical to that shown in FIG. 1, but the curved section 30 is more markedly curved, so that it ends up in the upper edge of the collar 34, on the side thereof, above the shoulder 18. This curved section 30 can have a single curvature or, as shown, two curvatures separated by an inflection point.

Figure 3:
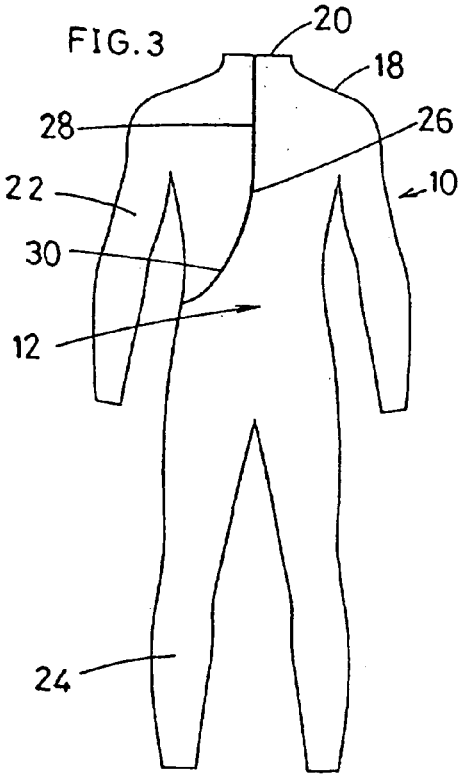
FIG. 3 illustrates a third embodiment of the invention.
Figure 4:
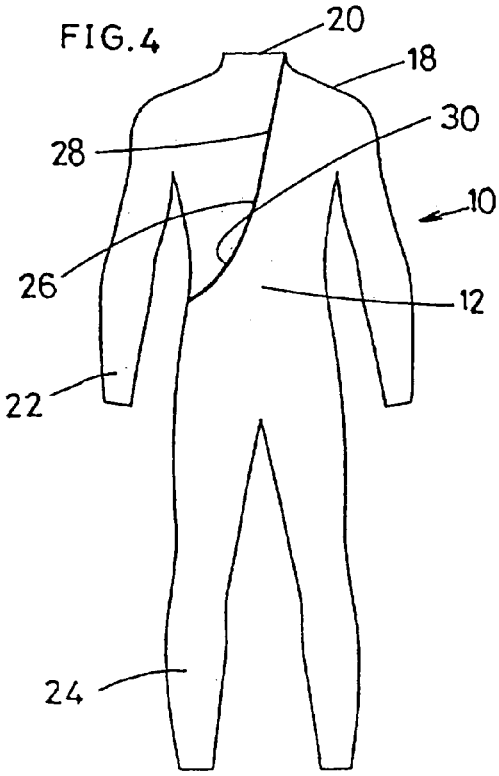
FIG. 4 illustrates a fourth embodiment of the invention.

In the embodiments of the invention shown in FIGS. 3 and 4, the rectilinear main section 28 is arranged in the upper portion of the torso, and it extends vertically downward, from the upper edge of the collar 34 down to approximately mid-height of the torso. In the embodiment of FIG. 3, this rectilinear section is substantially vertical, and it is arranged transversely in the center of the torso, or substantially there, in the plane of the user's spine. In the embodiment of FIG. 4, the rectilinear section is inclined in relation to the vertical, such that its upper end is off-centered transversely toward one of the user's shoulders.

In both cases, the main section is extended downward by a curved terminal/end section that is curved transversely toward the side of the garment, toward one of the user's hips. In the embodiment of FIG. 4, it is seen that the curved section is curved toward the hip located on the side opposite the shoulder toward which the upper end of the rectilinear section is inclined.

Due to its presence, the curved terminal/end section facilitates the manipulation of the slide of the slide fastener/zipper, especially when this manipulation is done by means of a flexible strap or cord that is connected to the slide of the slide fastener/zipper, such as connected to a pull tab thereof, which is connected to the slide.

The particular embodiments of the invention that have been described hereinabove are not considered to be limiting, and numerous alternative embodiments can be envisioned by one with ordinary skill in the art without leaving the scope of the invention.

What is claimed is:

1. An aquatic sports garment comprising:

a torso surface having an upper neckline edge, said torso surface including a front torso surface adapted to be positioned over a front of a wearer's torso and a rear torso surface adapted to be positioned over a back of a wearer's torso;

an opening formed as a slit arranged in the rear torso surface, the slit extending to the upper neckline edge;

a slide fastener extending along the slit for enabling the wearer to have the slit selectively placed in either an open position or a closed position, whereby the open position facilitates access to the garment for donning or removal of the garment, and whereby the closed position enables the wearer to use the garment during practice of an aquatic sport;

the slide fastener including, at least in the closed position, a main section having at least a portion positioned substantially in a transverse central part of the rear torso surface;

the slide fastener further including, at least in the closed position, at least one terminal section curved relative to the torso surface;

the curved terminal section of the slide fastener ending substantially halfway between the center of the garment and the side of the garment at the upper rear neckline edge.

* * * * *